United States Patent [19]

Ortiz et al.

[11] 4,147,147

[45] Apr. 3, 1979

[54] INTERNAL COMBUSTION ENGINE IGNITION SYSTEM

[76] Inventors: Francisco E. Ortiz; Federico E. Vidales, both of Tajin 698, Mexico City 13, Mexico

[21] Appl. No.: 855,189

[22] Filed: Nov. 28, 1977

[30] Foreign Application Priority Data

Nov. 29, 1976 [MX] Mexico ..... 167219

[51] Int. Cl.[2] ..... F02P 3/02

[52] U.S. Cl. ..... 123/148 DS; 123/148 DK

[58] Field of Search .... 123/148 CA, 148 D, 148 DK, 123/148 DS, 149 E, 179 BG; 200/19 R, 19 M; 315/209 R, 209 M

[56] References Cited

U.S. PATENT DOCUMENTS

| | | | |
|---|---|---|---|
| 2,380,707 | 7/1945 | Sawyer | 123/148 DS |
| 2,408,598 | 10/1946 | Beltz | 123/148 DS |
| 2,450,524 | 10/1948 | Root | 123/148 DS |
| 2,781,412 | 2/1957 | Mike | 200/19 M |
| 3,028,524 | 4/1962 | Espiru | 123/148 DS |
| 3,403,666 | 10/1968 | Soehner et al. | 123/148 D |
| 3,543,740 | 12/1970 | Vienat | 123/148 DS |
| 3,683,881 | 8/1972 | Tutui et al. | 123/148 D |
| 3,773,024 | 11/1973 | Ortiz | 123/148 DS |

*Primary Examiner*—Kathleen H. Claffy
*Assistant Examiner*—Gerald L. Brigance
*Attorney, Agent, or Firm*—Roylance, Abrams, Berdo & Farley

[57] ABSTRACT

A magnetic pulser having an energizing winding and a set of normally closed contacts is connected in the ignition system of an internal combustion engine with the contacts in series with the primary winding of the ignition system coil and the energizing winding of the pulser connected in parallel with the primary of the coil. The pulser includes a spring which biases the contacts toward a normally closed position and the strength of the spring is selected so that it is sufficient to resist opening of the contact set until the breaker points of the distributor are opened by the distributor cam.

1 Claim, 3 Drawing Figures

INTERNAL COMBUSTION ENGINE IGNITION SYSTEM

This invention relates to an improved ignition system for an internal combustion engine.

BACKGROUND OF THE INVENTION

Reference is made to U.S. Pat. Nos. 3,773,024 and 3,028,524, these references being the inventions of one of the present applicants. These prior patents involved an ignition system employing a vibrator which is actuated when the contacts closed in a conventional ignition distributor and, during the time in which they remained in this condition, produced a high voltage current in the coil which was transmitted to the sparkplugs to create, as a result, more efficient combustion. The primary difference between the prior patents is that two coils were used in the earlier application (U.S. Pat. No. 3,028,524), the conventional coil and a further self-induction coil which was actuated by a vibrator, while in the second of these inventions, the desired performance was obtained by using a single coil, i.e., the conventional coil of the ignition system, actuated by a magnetic pulser, which technique was much more efficient than the self-induction coil used in the first patent.

Furthermore, both systems used a circuit selective switch. A considerably increased performance was achieved in internal combustion engines, resulting in increased power and fuel savings. However, both presented the inconvenience of using, in the first place, a large number of components in the case of the earlier patent and, in the second place, the optimal efficiency of the system was not uniformly obtained over the entire operating range of the engine since, at certain engine rpms, particularly low rpm, a less efficient performance was obtained as compared with the performance obtained at high rpm.

BRIEF DESCRIPTION OF THE INVENTION

Accordingly, it is an object of the present invention to provide a further improved ignition system which involves a decreased number of components and which provides optimal performance which is consistent regardless of the rpm rate of the engine, thereby permanently achieving an optimal point in the combustion which results in fuel savings, a proportional increase in the power of the engine thus yielding greater acceleration and greater top speed, longer spark plug life and less frequent oil changes since the oil is maintained cleaner for a longer period of time due to a reduction of residues in the combustion.

A further object of the present invention is to provide a system which is usable not only in engines provided with conventional ignition systems but also in engines provided with electronic ignitions.

As compared with previously mentioned U.S. Pat. No. 3,028,524, the present system involves the elimination of the pulser condenser and the selector switch of the system since it has been found that these parts are not necessary because the systems operated when the contacts of the distributor were closed, thus establishing a cycle of interruptions during closing, which manner of operation is avoided in the present system due to the operation thereof when the contacts are open, the frequency of operation of the system in the present system being determined by the frequency of the breaker contacts of the distributor and the establishment of current in the secondary winding of the coil having the same frequency as that of the distributor contact. This permits production of a powerful and fast spark having a constant intensity over the range of engine speeds in order to obtain the maximum power thereof.

As will be seen, with this improvement it is not necessary to use a selector switch because the system of the present invention operates as a single system over the full range of engine operating conditions and is not used as a supplementary ignition system.

Briefly described, the invention includes, in an ignition system for an internal combustion engine of the type having a source of electrical power, an ignition switch connected to the power source, an ignition coil having primary and secondary windings, a distributor having a cam and cam-operated breaker points, a distributor arm and contacts, a plurality of spark plugs, one connected to each of the distributor contacts, the distributor arm being connected to the secondary winding of the coil and operative to sequentially complete a circuit to each of the contacts, the breaker points being connected in series circuit relationship with the primary winding, the source and ignition switch, the improvement comprising a magnetic pulser having an energizing winding, a set of normally closed contacts, a movable member carrying one of the contacts and movable to separate said one of the contacts away from the other thereof upon energization of the winding, and a spring urging the movable member to the position in which the contacts are closed, the set of contacts being connected in series circuit relationship between the primary winding of the coil and the ignition switch, the energizing winding being connected in parallel circuit relationship with the primary winding of the coil to obtain a reduction in the resistance and inductance of the circuit including both of the windings and application of the same voltage to both of said windings and a fast and complete saturation of the primary winding at high engine speeds, the spring being selected to have a force sufficient to resist opening of the contact set until the breaker points of the distributor are opened by said distributor cam, whereby the increase of current in said pulser energizing winding and primary winding is stopped upon opening of said breaker points and contact set so that the primary winding and pulser are operated at the same phase and frequency, the windings providing, by induction, a high current flow in the secondary winding of the coil and to the spark plugs.

In order that the manner in which the foregoing and other objects are attained in accordance with the invention can be understood in detail, a particularly advantageous embodiment thereof will be described with reference to the accompanying drawings, which form a part of this specification, and wherein.

Figure 3:
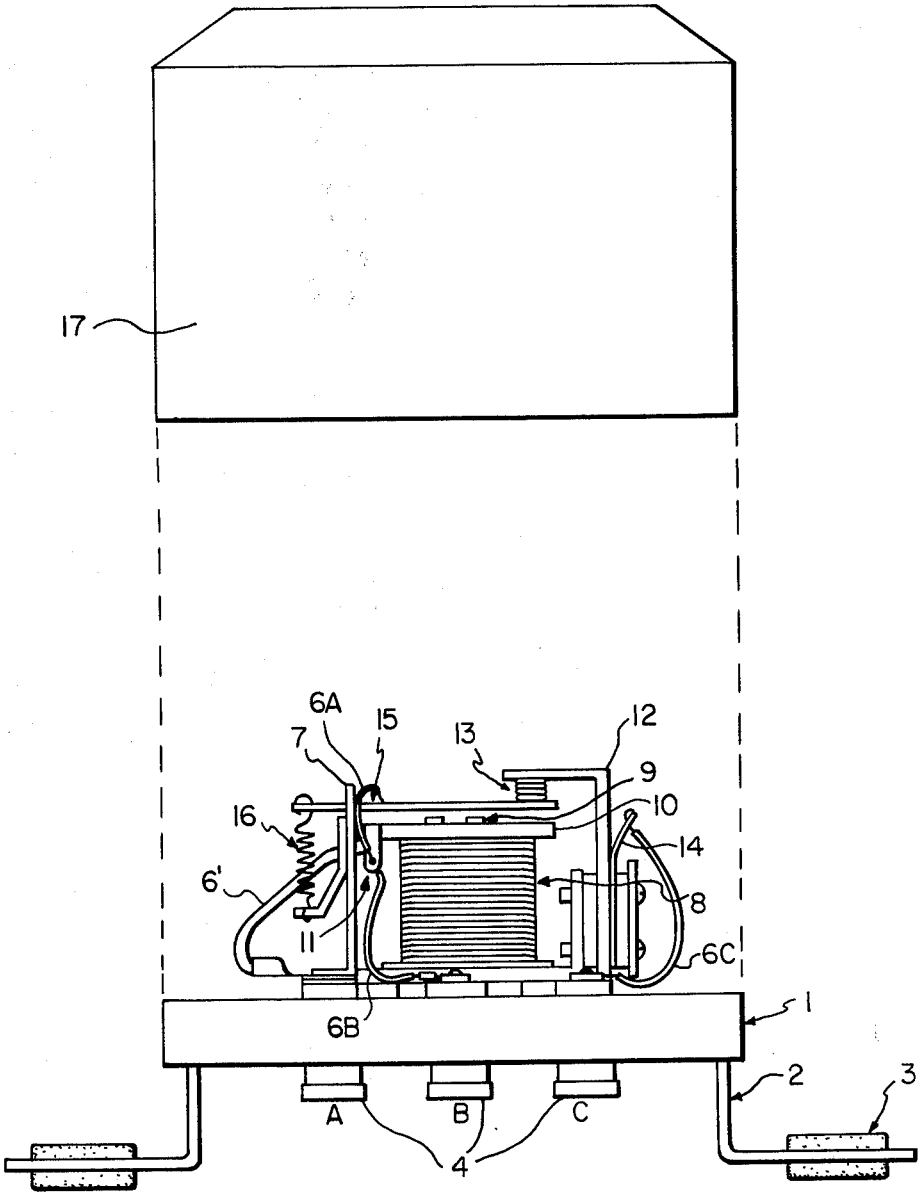
FIG. 3 is a side elevation, in partial section, of a magnetic pulser in accordance with the invention.

As shown in FIG. 3, which is a full size illustration of the magnetic pulser apparatus, it will be seen that this portion of the structure includes a base member 1 on which the components are assembled. The base is constructed of steel and is provided with angled support members 2 which are welded to the base member and can be finished using an electrolytic bath referred to as tropicalized finishing to provide the base and attachments with greater resistance against rusting. Rubber grommets 3 are inserted through openings in angles 2 for mounting in a suitable location in the engine compartment, the grommets being treated to withstand pressure, heat and grease, the grommets being provided to absorb vibration. Electrical connectors 4 are attached to base 1 and can be made of cadmium plated sheet steel to insure electrical conduction, the connectors being made in the shape of an elongated Z in order to clear the largest portion of the skirt of the base, the connectors being secured to the base by rivets of cadmium finished steel. The head of each rivet contacts the connector directly and is insulated from the base by washers made of bakelite or any similar insulating material with a diameter smaller than the opening for the rivet at the base plate to prevent contact therewith. The washers fit in embedded boxes, punched in the bottom of the base. Similar washers are also used at the top thereof, other aluminum washers being superimposed thereon so that, when riveted, they insure a uniform pressure. Brass terminals 5 are secured to one rivet of each connector and electrically connected to a connecting cable 6 which is connected to the pulser. The connectors are identified by the letters A, B and C, by which they will be referred to hereinafter.

The pulser armature 7 is made of cadmium finished sheet steel and is generally U-shaped, and is truncated on one side thereof. An energizing winding 8 is attached to the armature by means of a screw which contacts a core 9 of the pulser winding, the core being made of rolled iron. A plastic spool 10 made of polypropylene which withstands temperature up to 110° C., is used to insulate the core. The winding 8 of the pulser is wound around the spool and the ends thereof are attached to terminals 11 which are mounted on opposite sides of the spool, one of terminals 11 being connected to connector 4*a* and the other to connector 4*b* by means of cables 6*a* and 6*b*.

An L-shaped contact holder 12 is made of cadmium finished sheet steel, a tungsten disc 13 being riveted thereto. Contact holder 12 is also connected to a rectangularly-shaped copper connection 14 which is connected, in turn, to connector 4*c*, the current from the battery being carried thereto and subsequently to the contact holder and the contact itself through a connecting cable 6*c*.

In order to prevent electrical contact between the contact holder and the armature, rectangularly-shaped bakelite insulators are used, these being attached by means of a sheet steel pressure plate and steel screws, insulated by polypropylene tubes.

At the top of the armature there is a rocker arm anchored to the armature and made of cadmium finished sheet steel, a tungsten contact 13, the other contact, being riveted to one end thereof. The rocker arm is provided with a groove near the other end to insert one end of an extension coil spring 16, which can be made of flat steel, and which controls the force on the rocker arm to insure contact between contact members 13, and which establishes and controls the operating frequency of the pulser as will be described. The fine copper wire connector 6*a* is welded to the rocker arm piston and to terminal 11 to insure continuity of current therethrough. A cover 17 encloses the entire mechanism of the pulser and fits onto base 1, the cover being made of sheet steel finished with automotive enamel. The cover is a pressure fit on the base, and a sealer can be used to insure an airtight fit, the cover being secured by lag screws.

The pulser is attached to the base by means of screws with aluminum washers being used between the heads thereof and the base, and insulating bakelite washers at the bottom and top therefore between the base and the pulser.

Figure 1:
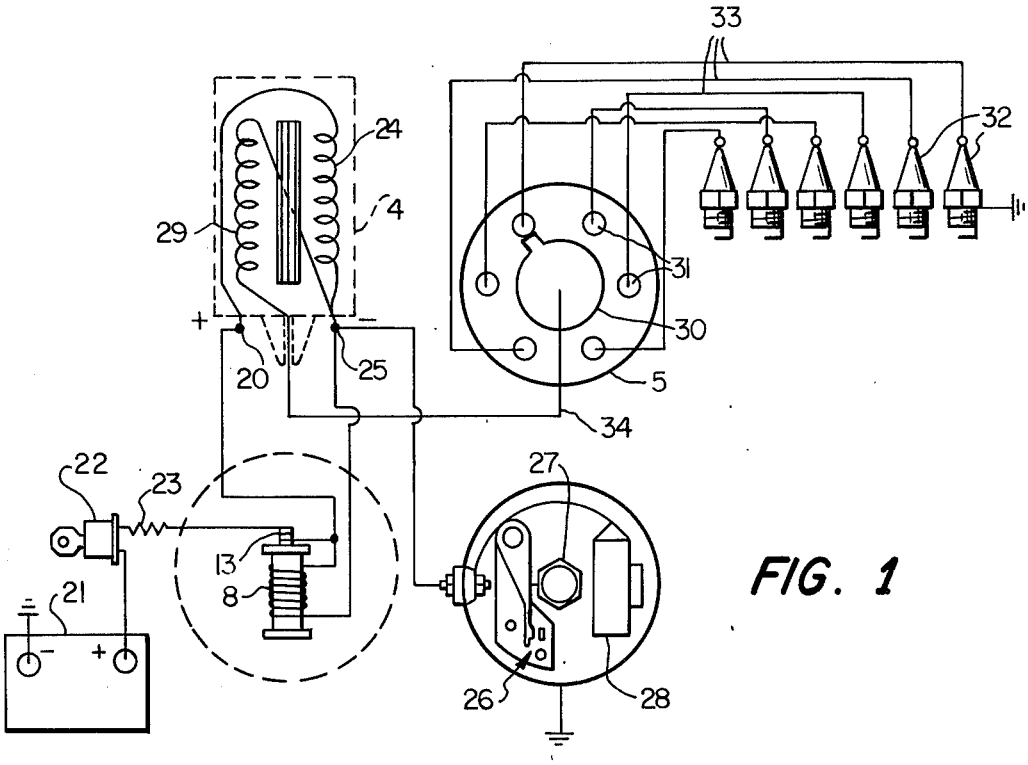
FIG. 1 is a schematic diagram showing the components of the system and their relative interconnections.
Figure 2:
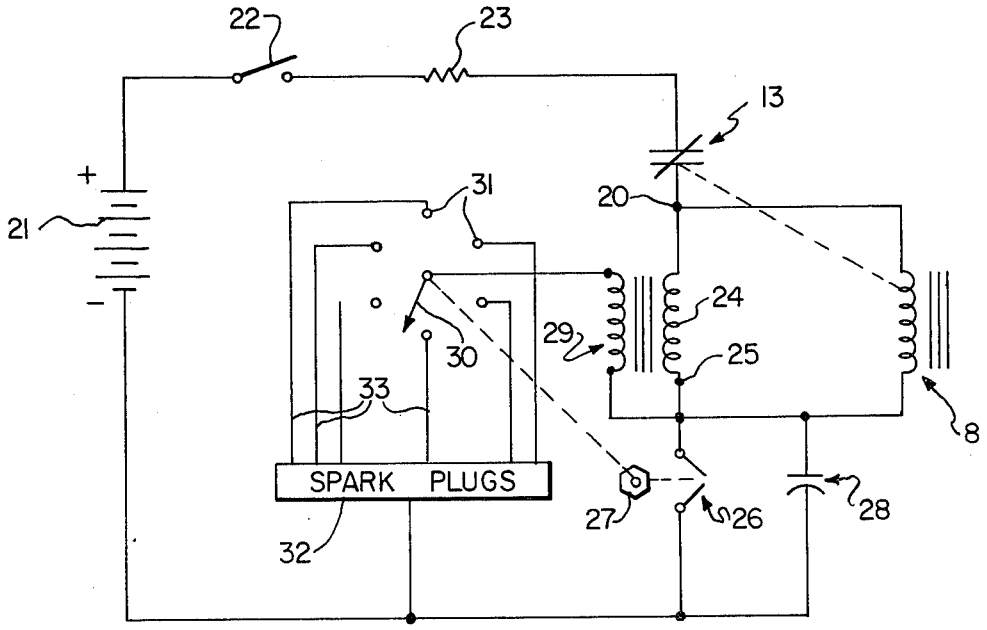
FIG. 2 is a schematic circuit diagram showing the circuit interrelationship of the components.

FIGS. 1 and 2 show the components and circuit diagram, respectively, of the system according to the present invention. As shown therein, the positive terminal of a battery 21 is connected to one terminal of an ignition switch 22, the other terminal of which is connected through a ballast resistor 23 to contacts 13 of the magnetic pulser. One of the contacts is connected to one terminal of energizing winding 8 of the pulser and also to a terminal 20 which is connected to the primary winding 24 of the automotive ignition coil. The other terminal 25 of the primary winding is connected to the other end of energizing winding 8 and also to one side of the breaker points, indicated generally at 26, in the distributor. The breaker points are actuated by a cam 27 of conventional nature in the distributor. A capacitor 28 is connected across the breaker points in the distributor, also in conventional fashion.

Terminal 25 of the primary winding is also connected to one end of the stationary winding 29 in the ignition coil, the other end thereof being connected to the rotating contact 30 in the distributor which makes contact with fixed contacts 31 therein as the distributor rotates to supply electrical energy to sparkplugs 32 through cables 33.

These components are similarly identified in FIG. 2, from which it will be seen that the energizing winding 8 of the pulser is connected in parallel circuit relationship with primary winding 24 and the parallel connection of these two windings is connected in series circuit relationship with both the breaker points 26 of the distributor and also the normally closed contacts 13 of the pulser, which contacts are actuated by energization of winding 8 in opposition to the force exerted by the spring 16.

In operation, current flows from battery 21 through its positive pole to the ignition switch 22 and through ballast resistance 23 to the contacts 13 of the pulser. Because winding 8 of the pulser and primary winding 24 are connected in parallel, the voltage between terminals 20 and 25 is common to both coils and the coils therefore see identical voltage. This attacts the armature of the rocker arm by magnetic force, this magnetic force being increased when the strength of springs 16 prevents the opening of the contacts 13 before the opening of the breaker point contacts 26 of the distributor, at which time the increase of current flow in the primary of the ignition coil is stopped. This establishes the frequency and phase of the current in winding 8 to be the same as in winding 24, the primary winding of the ignition coil, and the resulting relaxation of the fields associated with these windings produces a high level current by induction in the secondary winding at the same frequency as provided by contacts 26 of the distributor. The current flows to the cover of the distributor via cable 34 to rotor 30 and, through contacts 31 and cables 33, to sparkplugs 32.

As shown in FIG. 3, the current flows from the ignition switch to metal connector 4*c* which is connected to connector 14 through cable 6*c* and proceeds through contact holder 12 and contacts 13 to rocker arm 15. The current path is then through cables 6*a* to terminal 11 and then through 6*b* to metal connector 4*b*, from which it proceeds to the positive terminal 20 of the ignition coil. The connection 11, which is located at the opposite end of insulator 10, is connected to the metal connector 4*a* by means of a corresponding cable 6, thereby putting the coil of the pulser in parallel with the primary of the ignition coil and obtaining a reduction in the resistance and inductance of the equivalent circuit of both coils.

As will be recognized, the increased strength of spring 16, in conjunction with the common frequency of the system as described above, obtains the following advantages:

(a) A reduction of the resistance and inductance of the primary circuit of the ignition coil;

(b) A faster saturation of the primary of the ignition coil;

(c) A larger range in the magnitude of the current of the primary.

(d) A larger voltage increase in the primary winding of the ignition coil;

(e) A larger ionization voltage in the secondary of the ignition coil;

(f) Reduction and attenuation of the oscillations both in the primary and secondary of the coil after the spark is produced.

These advantages provide the spark with extra acceleration and power, thereby obtaining an improved ignition and more engine power.

When the winding of the coil of the pulser is placed in parallel with the primary winding of the ignition coil, a reduction in the resistance and inductance of the equivalent circuit of both coils, the normal and the pulser coils, may be obtained since they are placed in parallel. As a result, the speed of saturation of the primary of the ignition coil is increased, i.e., the same is effected in less time, obtaining the complete saturation even at high engine revolutions preventing delay of the spark and accordingly, a power loss as happened in the conventional system.

Another result is the increased magnitude of the intensity of the current which flows through the primary circuit due to the existence of a reduction of the resistance and since the feeding voltage of the battery is constant, based on Ohm's law, an increased magnitude of the current is obtained. When the magnitude of the current is increased, and the filling time of the primary of the ignition coil is reduced, saturation is rapidly increased, thereby obtaining the secondary to product an accelerated and more powerful spark.

When the magnitude of the current in the primary of the ignition coil is increased due to the characteristics of the pulser, a larger self-induction effect is obtained in the primary which results in an increased voltage therein as compared with the voltage at which the conventional system operates, a larger ionization voltage necessary for producing a more powerful and faster spark being obtained in the secondary.

Another result of the reduction of the resistance and inductance is that the oscillations existing after the occurrence of the spark are attentuated in a sharp manner; said oscillations are undesirable in the conventional ignition because they produce a spark delay together with a power loss. When being attenuated in a sharp manner due to the improvement, an improved performance is achieved.

This new device has the advantage, as mentioned before, of its ability to be used in electronic ignition systems in which electronic components have replaced the contacts of the distributor and the condenser since the new system operates improving the operation of the ignition coil which is used in electronic ignition.

While certain advantageous embodiments have been chosen to illustrate the invention, it will be understood by those skilled in the art that various changes and modifications can be made therein without departing from the scope of the invention as defined in the appended claim.

What is claimed is:

1. In an ignition system for an internal combustion engine of the type having a source of electrical power, an ignition switch connected to the power source, an ignition coil having primary and secondary windings, a distributor having a cam and cam-operated breaker points, a distributor arm and contacts, a plurality of spark plugs, one connected to each of said distributor contacts, the distributor arm being connected to the secondary winding of said coil and operative to sequentially complete a circuit to each of said contacts, said breaker points being connected in series circuit relationship with said primary winding, said source and said ignition switch, the improvement comprising a magnetic pulser having an energizing winding, a set of normally closed contacts, a movable member carrying one of said contacts and movable to separate said one of said contacts away from the other thereof upon energization of said winding, and a spring urging said movable member to the position in which said contacts are closed, said set of contacts being connected in series circuit relationship between said primary winding of said coil and said ignition switch, said energizing winding being connected in parallel circuit relationship with said primary winding of said coil to obtain a reduction in the resistance and inductance of the circuit including both of said windings and application of the same voltage to both of said windings and a fast and complete saturation of the primary winding even at high engine speeds, said spring being selected to have a force sufficient to resist opening of said contact set until the breaker points of said distributor are opened by said distributor cam, whereby the increase of current in said pulser energizing winding and primary winding is stopped upon opening of said breaker points and contact set so that the primary winding and pulser are operated at the same phase and frequency, said windings providing, by induction, a high current flow in the secondary winding of said coil and to said spark plugs.

* * * * *